US006568798B1

(12) United States Patent
Yoshida et al.

(10) Patent No.: US 6,568,798 B1
(45) Date of Patent: May 27, 2003

(54) INK-JET PRINT HEAD HAVING INK CHAMBERS DEFINED BY AN ENTIRE THICKNESS OF A CHAMBER SHEET, AND METHOD OF MANUFACTURING THE SAME

(75) Inventors: Hitoshi Yoshida, Konan (JP); Atsuo Sakaida, Gifu (JP); Yoshihumi Suzuki, Ena (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/411,641

(22) Filed: Oct. 4, 1999

(30) Foreign Application Priority Data

Oct. 20, 1998 (JP) ..... 10-298434

(51) Int. Cl.[7] ..... B41J 2/45
(52) U.S. Cl. ..... 347/71
(58) Field of Search ..... 347/69, 70, 71

(56) References Cited

U.S. PATENT DOCUMENTS 4,680,595 A 7/1987 Cruz-Uribe et al.
5,289,209 A * 2/1994 Suzuki et al. ..... 347/71
5,669,125 A * 9/1997 Shida ..... 29/25.35
5,723,053 A 3/1998 Momose et al.
5,956,058 A 9/1999 Momose et al.
6,168,255 B1 * 1/2001 Nagashima ..... 347/20
6,174,040 B1 * 1/2001 Hotomi ..... 347/20

* cited by examiner

*Primary Examiner*—Hezron Williams
*Assistant Examiner*—Charlene Dickens
(74) *Attorney, Agent, or Firm*—Oliff & Berridge, PLC

(57) ABSTRACT

A cavity plate for an ink-jet printhead includes a base material and a chamber sheet. An ink channel array constituting ink chambers is provided through the chamber sheet by a wire electric discharge machine, while an ink reservoir is formed on the base material by a wire electric discharge machine. Then, the chamber sheet and the base material are bonded to one another. Nozzles to eject ink may be created on a nozzle sheet, which is later connected to the chamber sheet. Alternatively, the nozzles may be directly provided on the chamber sheet. Thus, the cavity plate is provided having the ink chambers and the ink reservoir with high precision, without the increase in the production cost.

28 Claims, 9 Drawing Sheets

PRIOR ART

INK-JET PRINT HEAD HAVING INK CHAMBERS DEFINED BY AN ENTIRE THICKNESS OF A CHAMBER SHEET, AND METHOD OF MANUFACTURING THE SAME

BACKGROUND OF THE INVENTION

1. Field of the Invention

The present invention relates to a cavity plate of an ink-jet printhead of an ink-jet printer, and further relates to the manufacturing process of the cavity plate.

2. Description of Related Arts

A conventional ink-jet printhead of an ink-jet printer is formed of a cavity plate that includes ink chambers, which are divided by separation walls, and a piezoelectric element attached to the cavity plate. In such an ink-jet printhead, a pressure change is caused within the ink chambers by the piezoelectric element, and which forces the ejection of ink through nozzles provided on the cavity plate.

Various manufacturing processes have been applied to produce the cavity plate. For example, the cavity plate can be made of ceramics or resin by injection molding, wherein the ink chambers and an ink reservoir are integrally molded. Also, the cavity plate can be made of photosensitive glass, on which the ink chambers and the ink reservoir are formed by an etching process.

However, many problems arise from the aforementioned conventional manufacturing process of the cavity plate. These problems are discussed below.

In injection molding of ceramics or resin, it is necessary to produce the mold for molding the cavity plate on which the ink chambers are aligned at minute intervals. This complicated arrangement causes the mold to be time-consuming and expensive to manufacture, and at the same time, difficult to modify the cavity plate immediately as necessity requires. Further, the materials (such as ceramics and resin) are necessarily sintered after injection molding, whereupon the materials shrink during the sintering process. This shrinkage has been a problem in manufacturing the cavity plate accurately due to the difficulty in its control.

In the etching process of photosensitive glass, it is difficult to control the depth of the ink chambers and the ink reservoir. Thus, the ink chambers and the ink reservoir cannot be formed with high precision.

SUMMARY OF THE INVENTION

It is therefore an object of the present invention to solve the problems described above.

Specifically, one aspect of the invention is of a cavity plate for an ink ejecting device, comprising multiple nozzles that eject ink, ink chambers arranged at regular intervals and connected to the nozzles, and an ink reservoir connected to all the ink chambers. The ink ejecting device having such a cavity plate ejects ink from the ink chambers through the nozzles, based on a pressure change caused within the ink chambers by a piezoelectric element.

According to the present invention, the cavity plate can be made of a plate-shaped base material having the ink reservoir thereon, and a chamber sheet pierced to form an ink channel array constituting the ink chambers and attached to the base material.

With this arrangement, the channel and the surface of the base material attached to the chamber sheet form the ink chamber as the circumferential wall and the base. The depth of the ink chambers is determined by the thickness of the chamber sheet, regardless of the accuracy in creating the ink channels. Such channels can be created by, for example, an electric discharge machine, etching process, or press working, without the necessity of the sintering process. This makes it possible to form accurate breadth of the ink chamber as well as accurate spacing width between the adjacent ink chambers. In this way, the ink chambers can be formed so precisely that uniform ink ejection performance is obtained.

Further, a nozzle sheet comprising the nozzles thereon is bonded to the front edge of the chamber sheet. The nozzles are connected to the ink chambers with opening portions provided at the tip of the ink channels. Alternatively, the nozzles may be formed directly on the front edge of the chamber sheet without the use of the nozzle sheet. In this case, the nozzles are connected to the ink chambers with connecting holes provided through the front edge portion of the chamber sheet. With these arrangements, the ink chambers are easily and certainly connected to the nozzles, and which results in good ink ejecting performance.

The chamber sheet and the base material have a similar coefficient of thermal expansion. Even if using hot-melt ink; which melts at a high temperature, the adhesive strength between the chamber sheet and the base material is maintained without warping when subjected to heat. It is therefore possible to prevent pressure leakage from the ink chambers, and thereby possible to eject ink appropriately.

The base material is much thicker than the chamber sheet, whereby the ink reservoir has a much larger capacity than the ink chamber. In this configuration, the ink reservoir certainly absorbs the pressure in the direction toward the ink reservoir, when applying a pressure to ink within the ink chambers. This reduces crosstalk between the adjacent ink chambers. At the same time, the base material has a high rigidity due to its thickness, and prevents pressure leakage in order to eject ink efficiently.

Another aspect of the invention is of the manufacturing process of the aforementioned cavity plate which does not increase production cost. This manufacturing process includes the steps of: forming the ink channel array constituting the ink chambers through the chamber sheet; forming the ink reservoir on the base material; bonding the chamber sheet and the base material; and connecting the ink chamber and the nozzle.

In the step of forming the ink channel array, for example, an electric discharge machine, etching process, or press working can be applied, without the necessity of a mold for injection molding. Thus, it is possible to reduce the production cost significantly, and at the same time, possible to modify the cavity plate immediately as necessity requires. Additionally, multiple chamber sheets that are laid one upon another can be processed simultaneously, which leads to the reduction in the production cost by sheet and the improvement of manufacturing efficiency.

In the step of connecting the ink chamber and the nozzle, the front edge portion of the chamber sheet is cut off after bonding the chamber sheet and the base material in order to provide opening portions at the tip of the channels. Since the opening portions are not formed at the time when the ink channel array is formed, the front edge portion of the chamber sheet is still sheet-shaped. Such a chamber sheet is easy to bond to the base material. Further, being reinforced with the base material, the front edge portion of the chamber sheet is easily cut off after the bonding without distorting the ink channels.

The opening portions are thus formed accurately at tip of the ink channels so that the ink chambers are certainly connected to the nozzles. Alternatively, the nozzle may be created directly on the front edge of the chamber sheet. At the same time, connecting holes are formed between the nozzles and the ink chambers through the front edge portion of the chamber sheet. Thus, the ink chamber and the nozzle are connected more precisely.

BRIEF DESCRIPTION OF THE DRAWINGS

The present invention will be better understood from the following detailed description of the invention with reference to the accompanying drawings, in which.

DETAILED DESCRIPTION OF PREFERRED EMBODIMENTS

Hereinafter, preferred embodiments of the invention will be explained with reference to the drawings.

[First Embodiment]

The first embodiment will be described referring to FIGS. 1 to 4. Herein, FIG. 9 will also be referred to compare the present invention and the conventional technique.

Figure 2:
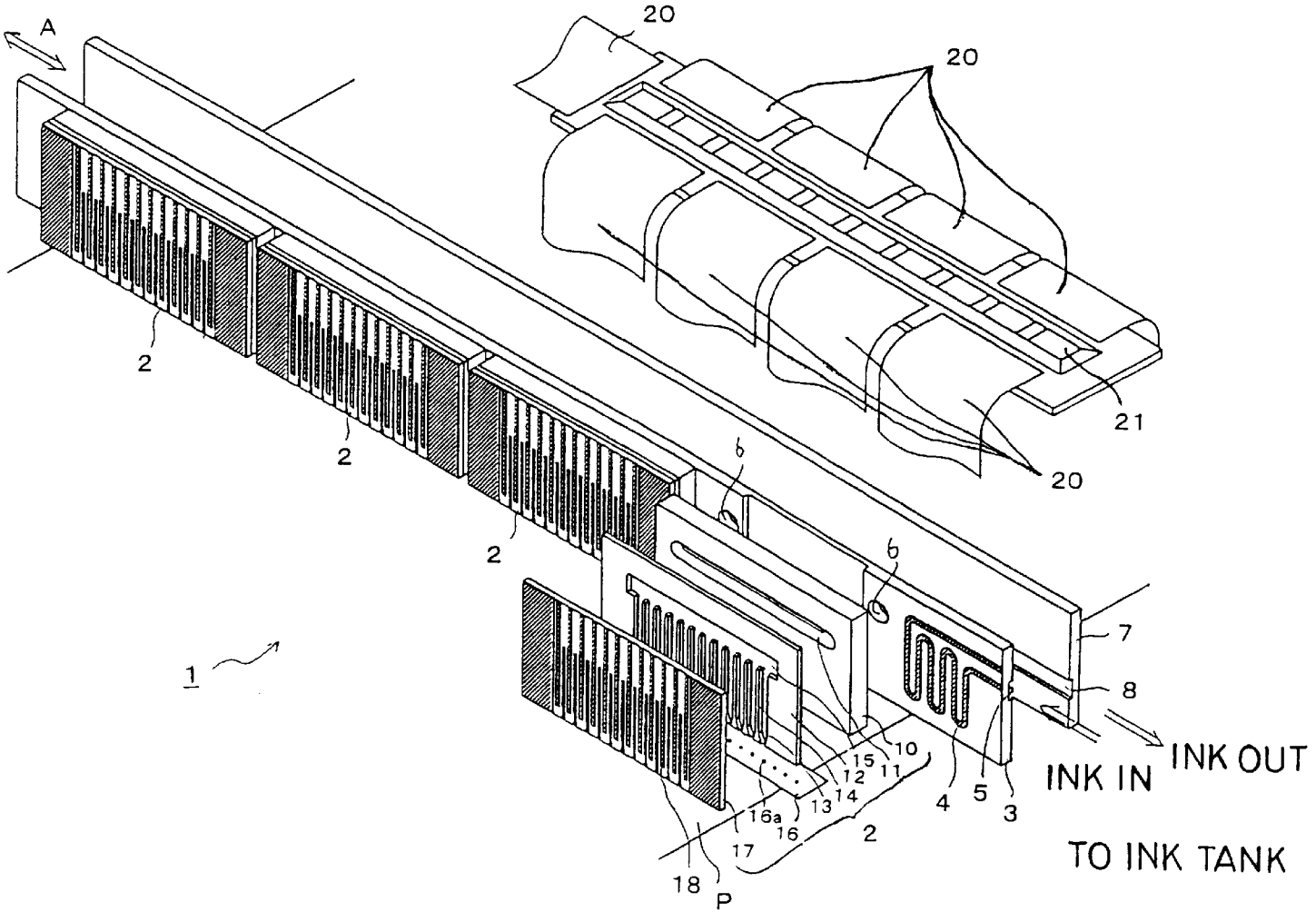
FIG. 2 is an exploded perspective view of a line-type ejecting device according to the first embodiment of the invention.

First, an ink ejecting device according to the first embodiment of the invention will be described with reference to FIG. 2. FIG. 2 is an exploded perspective view of a line-type ink ejecting device 1.

As shown in FIG. 2, multiple piezoelectric ink-jet printheads 2 are provided side by side on the front surface of an ink flow plate 3. The ink flow plate 3 is made of an aluminum or a magnesium plate. A heater 4, made of patterned stainless steel on a polyimide film, is also attached to the front surface of the ink flow plate 3. On the rear surface of the ink flow plate 3, an inlet 5 for ink is formed to supply ink from an ink storage tank (not shown). Further, ink supply holes 6 formed through the ink flow plate 3 are connected to the inlet 5. The ink from the inlet 5 is supplied to the front surface of the ink flow plate 3 through these ink supply holes 6. An ink flow plate 7 is adhered to the rear surface of the ink flow plate 3. This ink flow plate 7 is also made of an aluminum or a magnesium plate. An outlet 8 to return ink to the ink storage tank is formed on the front surface of the ink flow plate 7.

The piezoelectric ink-jet printhead 2 includes a cavity plate and a piezoelectric element 17, wherein the cavity plate is formed of a base plate 10 as a base material, a chamber sheet 12, and a nozzle plate 16.

The base plate 10 is also made of an aluminum or a magnesium plate, on which an ink reservoir 11 is formed so as to connect to the ink supply holes 6 on the ink flow plate 3. The base plate 10 is bonded to the ink flow plate 3 with an adhesive.

The chamber sheet 12, which is a sheet-shaped material made of stainless steel or nickel, is bonded to the base plate 10 with an adhesive. The chamber sheet 12 has multiple ink chambers 13 that are open (to the front in FIG. 2), and separation walls 14 that divide each chamber. A slot 15 is also formed on the chamber sheet 12 so as to connect to all the ink chambers 13 and the ink reservoir 11.

The nozzle plate 16 is made of a polyimide sheet having multiple nozzles 16*a* thereon. Each of the ink chambers 13 gradually becomes narrow toward the side opposite to the slot 15, and has an opening potion at the front edge of the chamber sheet 12. The nozzle plate 16 is bonded to the chamber sheet 12 with an adhesive so that the opening portions and the nozzles 16*a* are connected to one another.

The piezoelectric element 17 is further bonded to the chamber sheet 12, thereby covering the openings of the ink chambers 13. This piezoelectric element 17 includes piezoelectric ceramic layers made of lead zirconate titanate (PZT) material having a piezoelectric effect. On each layer of the piezoelectric ceramics, negative and positive electrode patterns 18 are provided with, for example, the mixture of silver and palladium by screen process printing.

The electrode patterns 18 are connected to a power source (not shown). This power source is further connected to a drive IC 21 through flexible printed boards 20. The drive IC 21 is connected to a main board (not shown) comprising a CPU through the flexible printed boards 20. The drive IC 21 is driven in correspondence with the signal from the main board, and then, supplies the signal to the electrode patterns 18. The piezoelectric ceramic layers distort corresponding to the signal, and which causes a pressure change within the ink chamber 13. Based on the pressure change, ink is ejected from the ink chambers 13 through the nozzles 16*a* provided on the nozzle plate 16.

Such ejection of ink is performed by each piezoelectric ink-jet printhead 2 simultaneously, while the ink ejecting device 1 is moved in direction "A". Printing is executed at high speed on a sheet of paper P by line.

Next, the manufacturing process and the structure of the cavity plate according to the first embodiment of the invention will be explained in more detail with reference to FIGS. 1, 3 and 4.

Figure 1:
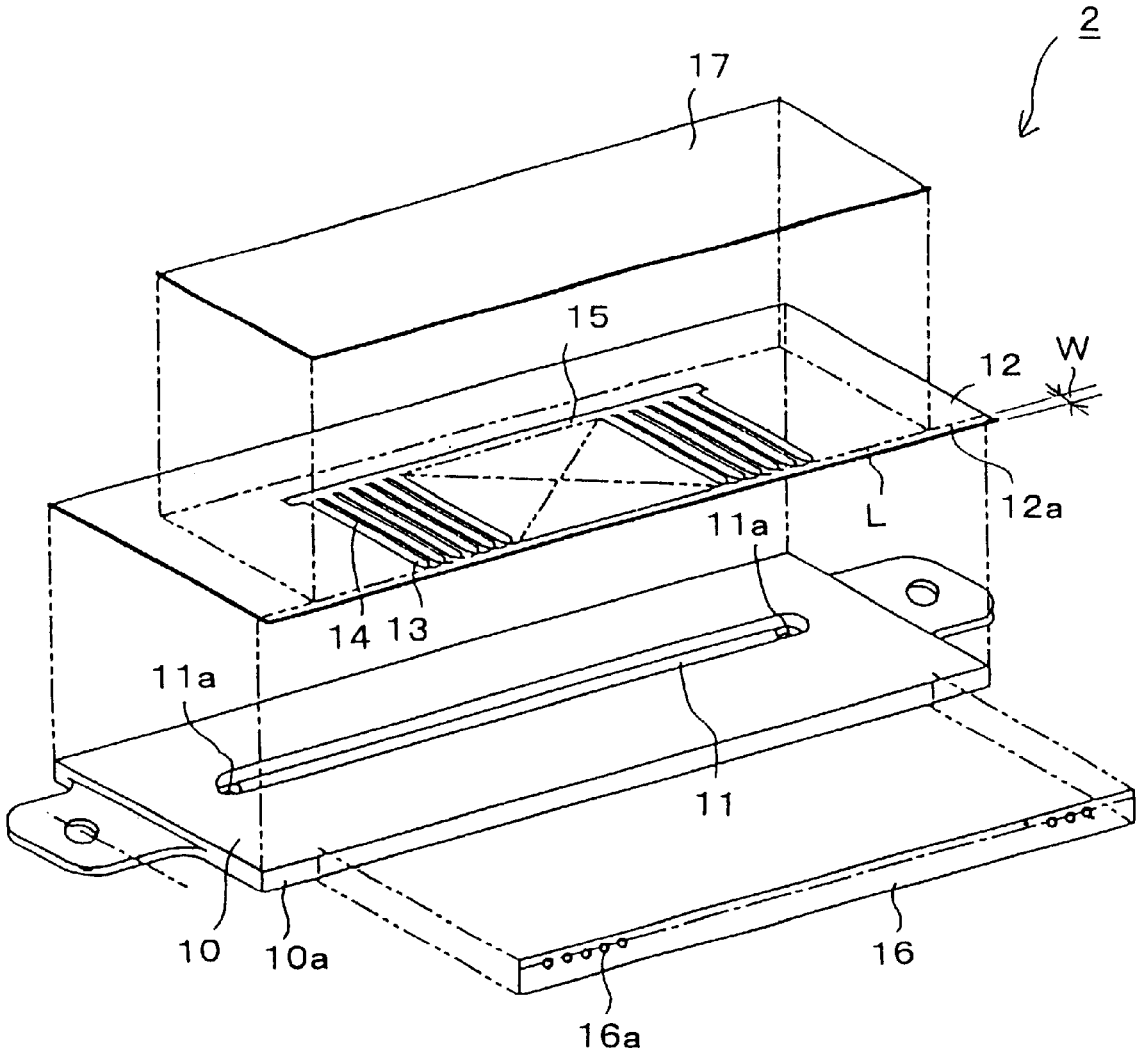
FIG. 1 is an exploded perspective view of an ink-jet printhead according to the first embodiment of the invention.
Figure 3:
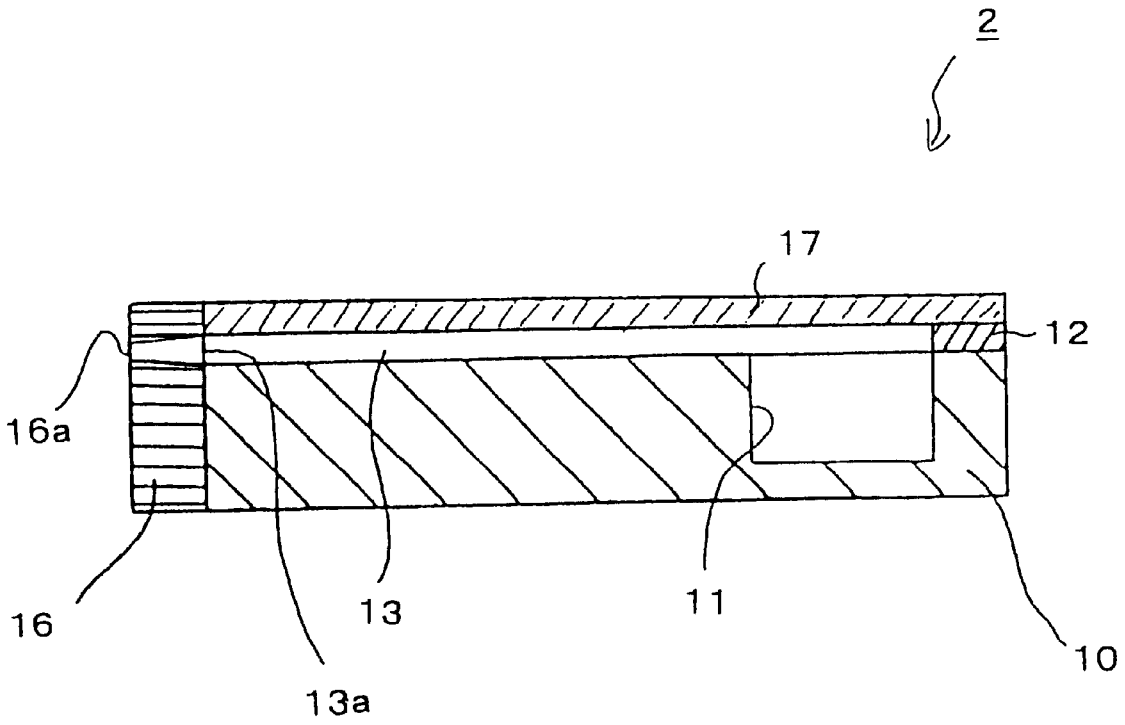
FIG. 3 is a cross-sectional view of the ink-jet printhead of FIG. 1.
Figure 4:
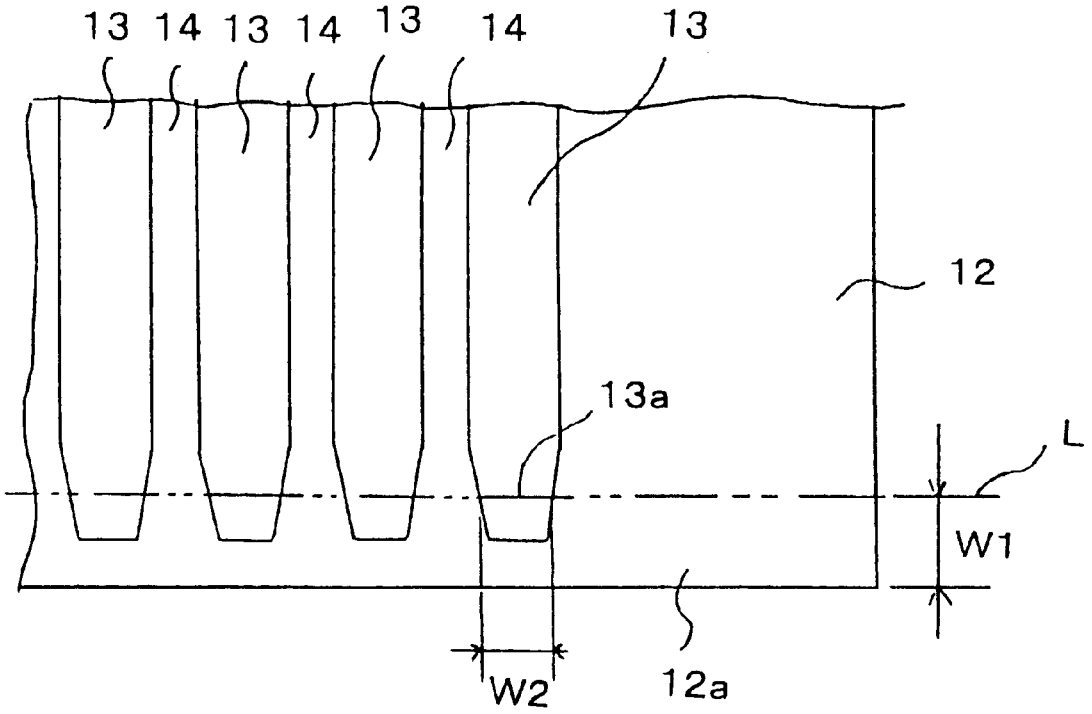
FIG. 4 is a top view schematically showing the front edge portion of a chamber sheet in the ink-jet printhead of FIG. 1.

FIG. 1 is a perspective view, FIG. 3 is a sectional view of the ink-jet printhead 2, and FIG. 4 is a partial top view schematically showing the front edge portion of the chamber sheet 12.

Firstly, the ink reservoir 11 is created on the base plate 10, which is made of an aluminum or a magnesium plate of 2 mm thickness, by cutting. This ink reservoir 11, as shown in FIG. 1, is formed longitudinally so as to connect with all the ink chambers. At both ends of the ink reservoir 11, ink flow holes 11*a* are created and connected to the ink supply holes 6 provided on the ink flow plate 3.

Next, one sheet of the chamber sheet 12 of 100 $\mu$m thickness, made up of stainless steel or nickel is processed by an etching process. The ink channel array constituting the ink chambers 13 is created through the chamber sheet 12 as well as the slot 15 connected to the ink reservoir 11. The channels are shaped so as to become narrow toward the front edge portion, as shown in FIG. 4. The width of the wall portion between two adjacent ink chambers is approximately 80 to 100 μm. The length of the wall portion between two adjacent ink chambers is approximately 5 to 10 mm. The width of each ink chamber is approximately 250 μm.

Instead of the etching process, a wire electric discharge machine can also be used. In such a case, 50 to 100 sheets of the chamber sheet 12 are laid one upon another and processed simultaneously by the wire electric discharge machine.

Then, the chamber sheet 12 is bonded to the base plate 10 with a resinous adhesive having a glass transition point at 130 to 150° C. so that a standard line L matches the front edge 10*a* of the base plate 10. In this case, the front edge portion 12*a* of the chamber sheet 12, having a width W1, sticks out from the base plate 10. After bonding the chamber sheet 12 and the base plate 10, this front edge portion 12*a* is cut off by a cutting process. Thus, opening portions 13*a* of a diameter W2 are created at the tip of the channels.

After that, the nozzles 16*a* are produced on the nozzle sheet 16, which is made of polyimide, by a laser beam apparatus. As shown in FIG. 3, the nozzles 16*a* have a diameter that is equal to or smaller than their diameter W2 at the side attached to the base plate 10 and the chamber sheet 12, and which becomes narrow toward the front. The diameter of each nozzle 16*a* is approximately 25 μm. The diameter W2 is approximately 50 μm. The nozzle sheet 16 having the nozzles 16*a* formed as described above is bonded to the base plate 10 and the chamber sheet 12 with the resinous adhesive so that each nozzle 16*a* matches the opening portion 13*a* of the channel, whereby the cavity plate is completed. Later, the piezoelectric element 17 is bonded to the chamber sheet 12 with the resinous adhesive to form the ink-jet printhead 2.

In this completed configuration, the channel forming the ink chamber is surrounded by the base plate 10 and the piezoelectric element 17, as shown in FIG. 3. In other words, the ink chamber 13 is defined by the surface of the base plate 10 attached to the chamber sheet (as the base), the piezoelectric element 17 (as the top), and the separation walls 14 (as the circumferential wall). The depth of the ink chamber 13 is accurately controlled, since the ink channel array is provided through the chamber sheet 12, and this depth is determined by the thickness of the chamber sheet 12. Further, being processed by a wire electric discharge machine, the breadth of the ink chamber is also accurate, as well as the spacing width between the adjacent chambers. It is therefore possible to produce the ink chamber 13 with high precision, having a uniform capacity.

Still further, the opening portions 13*a* are produced by a wire electric discharge machine after bonding the chamber sheet 12 to the base plate 10. This makes it easy to bond the chamber sheet 12 to the base material 10, since the chamber sheet 12 is sheet-shaped at the time when it is bonded. In addition, the chamber sheet 12 is reinforced with the base material by bonding with one another, although the chamber sheet 12 itself is easy to bend due to its thinness. Thus, the front edge portion 12*a* of the chamber sheet 12 can be easily cut off without distorting the ink channels. In this way, the opening portions 13*a* are accurately formed to obtain certain connections between the ink chambers 13 and the nozzles 16*a*.

As described above, the good ink ejecting performance (including the uniform ink ejecting velocity and the uniform ink ejecting amount) can be achieved by forming the cavity plate with high precision.

Besides, the chamber sheet 12 and the base plate 10 are made of a material having a similar coefficient of thermal expansion in the present embodiment. Even if using hot-melt ink, the chamber sheet 12 does not warp when subjected to heat, thereby, maintaining the adhesive strength between the chamber sheet 12 and the base plate 10. The ejection of ink is appropriately performed without pressure leakage between the ink chambers.

Furthermore, the base plate 10 is much thicker than the chamber sheet 12, whereby the ink reservoir has a much larger capacity than the ink chamber 13 as shown in FIG. 3. In this configuration, the pressure toward the ink reservoir 11 is certainly absorbed by the ink reservoir 11. It is possible to prevent ink flowing into the other ink chamber 13. In addition, as the base plate 10 has a high rigidity due to its thickness, a pressure change caused by the piezoelectric element 17 is efficiently utilized to eject ink without pressure leakage.

Figure 9:
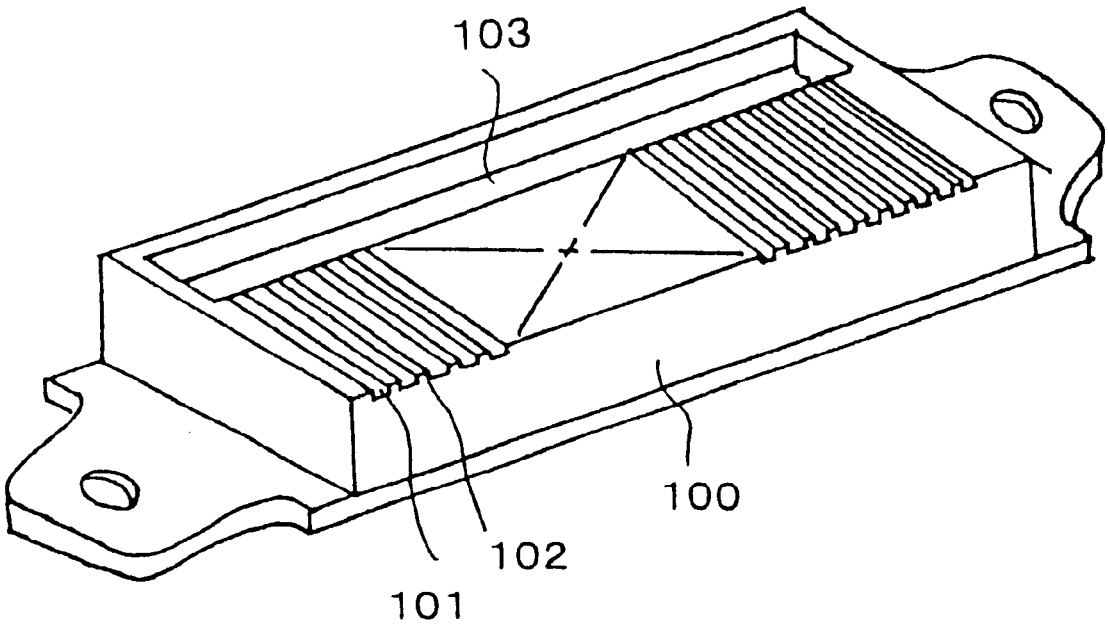
FIG. 9 is a perspective view of a conventional cavity plate.

The superior effects of the cavity plate according to the present embodiment will be more apparent, when comparing it to the cavity plate manufactured by the conventional process. FIG. 9 is a perspective view of a conventional cavity plate 100.

The cavity plate 100 is made of the mixture of powdered ceramics, and resin or binder, and manufactured by an injection molding and sintering process. It is therefore necessary to produce the mold having grooves and projections for integrally molding ink chambers 101, an ink reservoir 103 and separation walls 102, as shown in FIG. 9. However, utilizing the mold comprising the grooves and the projections with such close spacing is time-consuming and expensive to manufacture. This results in high expense and late achievement when modifying the ink chambers 101, because another mold has to be produced.

Furthermore, the cavity plate 100 is necessarily sintered in this conventional process, in which the ceramic material shrinks. The dimension of the ink chambers 101 is minimally controlled due to the difficulty in controlling the shrinkage.

Heretofore, the cavity plate 101 has also been made of photosensitive glass by etching the ink chambers thereon. It is hard to control the depth of the ink chamber 101 in this process, thereby, difficult to control the dimensions of the cavity plate precisely.

On the other hand, the cavity plate according to the present embodiment is manufactured without the mold. This reduces the production cost of the cavity plate significantly. Specifically, 50 to 100 sheets of chamber sheet can be manufactured simultaneously, and which leads to reduction in the production cost by sheet and improvement of the manufacturing efficiency. Further, since the cavity plate of the present embodiment is manufactured by a wire electric discharge machine without the sintering process, it is possible to create the ink channel array constituting the ink chambers 13 accurately. Particularly, as the ink channel array is provided through the chamber sheet 12, the depth of the ink chamber 13 can be determined only by the thickness of the chamber sheet 12. Still further, it makes it possible to modify the ink chamber 13 immediately, as necessity requires, without the use of the mold for injection molding.

As described above, the present embodiment has superior effects on reduction in the production cost and manufacturing accuracy of the cavity plate.

[Second Embodiment]

Next, the second embodiment of the present invention will be explained with reference to FIGS. 5 and 6. Herein, like reference numerals have been used throughout to designate like elements in the drawings.

Figure 5:
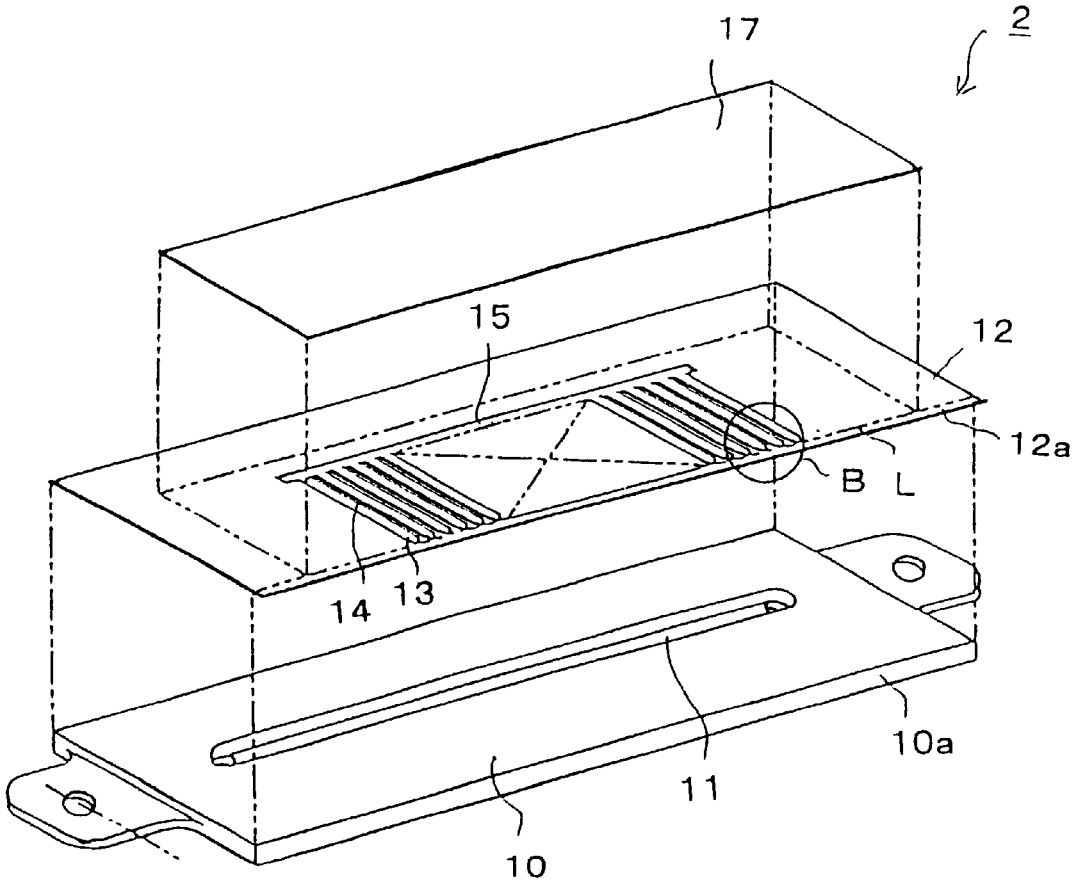
FIG. 5 is an exploded perspective view of an ink-jet printhead according to the second embodiment of the invention.
Figure 6:
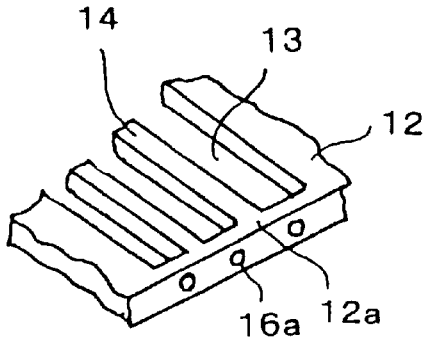
FIG. 6 is an expanded view of nozzles provided on a cavity plate in the ink-jet printhead of FIG. 5.

FIG. 5 is an exploded perspective view of the piezoelectric ink-jet printhead according to the second embodiment. FIG. 6 is a partial expanded view of the front edge 12*a* of the chamber sheet 12 that corresponds to the circled area B shown in FIG. 5.

According to the second embodiment, the cavity plate also includes the chamber sheet 12 and the base plate 10. The nozzles 16*a* are first produced directly on the front edge portion 12*a* of the chamber sheet 12 by a laser beam apparatus, as shown in FIG. 6. At the same time, connecting holes (not shown) are formed through the chamber sheet 12 so as to connect the nozzles 16*a* to the ink chambers 13.

Then, the chamber sheet 12 and the base plate 10 are bonded to one another so that the standard line L of the chamber sheet 12 matches the front edge 10*a* of the base plate 10. After that, the piezoelectric element 17 is bonded to the chamber sheet 12, whereby the ink-jet printhead 2 is completed.

The process of forming the ink channel array constituting the ink chambers 13, the separation walls 15 and the slot 15, and the process of forming the ink reservoir 11 on the base plate 10, are the same in the first and the second embodiments. Also, the method of bonding portions is the same in the first and the second embodiments.

According to the present embodiment, the nozzles 16*a* are produced directly on the chamber sheet 12 as mentioned above. This makes it possible to connect the ink chambers 13 to the nozzles. 16*a* more precisely. At the same time, the cavity plate can be accurately manufactured at low production cost. In addition, since the nozzle plate is not bonded with an adhesive, problems (such as clogging up the nozzles 16*a* with the adhesive) can be prevented. Thus, the ejection of ink is appropriately performed in this configuration.

[Third Embodiment]

Figure 7:
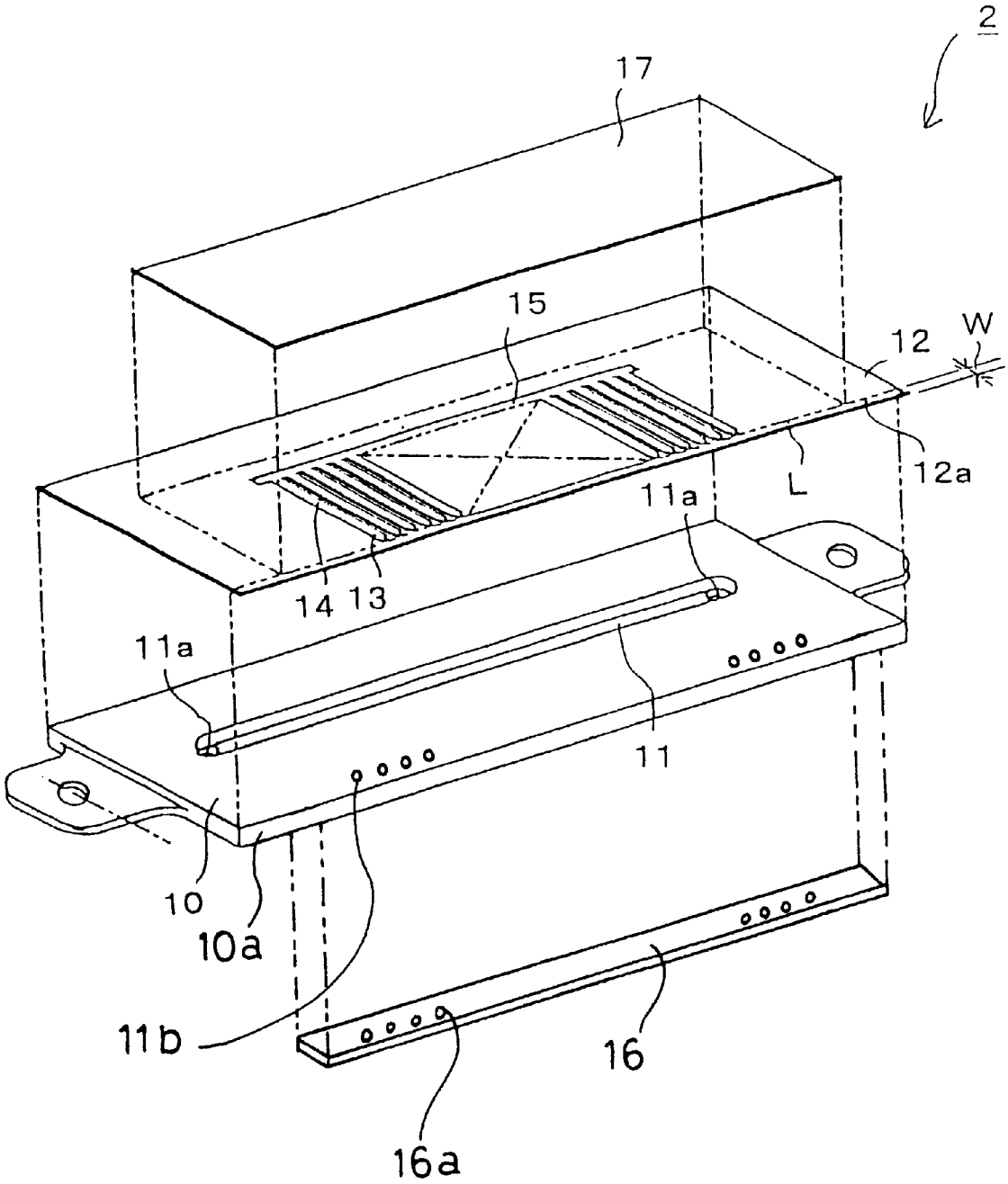
FIG. 7 is an exploded perspective view of an ink-jet printhead according to the third embodiment of the invention.

FIG. 7 is an exploded perspective view of an ink-jet printhead according to the third embodiment of the invention. The third embodiment is different from the first embodiment shown in FIG. 1 in that the nozzle sheet 16 is not connected to the front edge 10*a* of the base plate 10. Instead, FIG. 7 shows that the nozzle sheet 16 of the third embodiment is attached to the lower surface of the base plate 10. Nozzles 16*a* of the nozzle sheet 16 communicate with channels 11*b* that extend from a top surface of the base plate 10 to its lower surface. The channels 10*b* connect the nozzles 16*a* to the ink chambers 13.

[Fourth Embodiment]

Figure 8A:
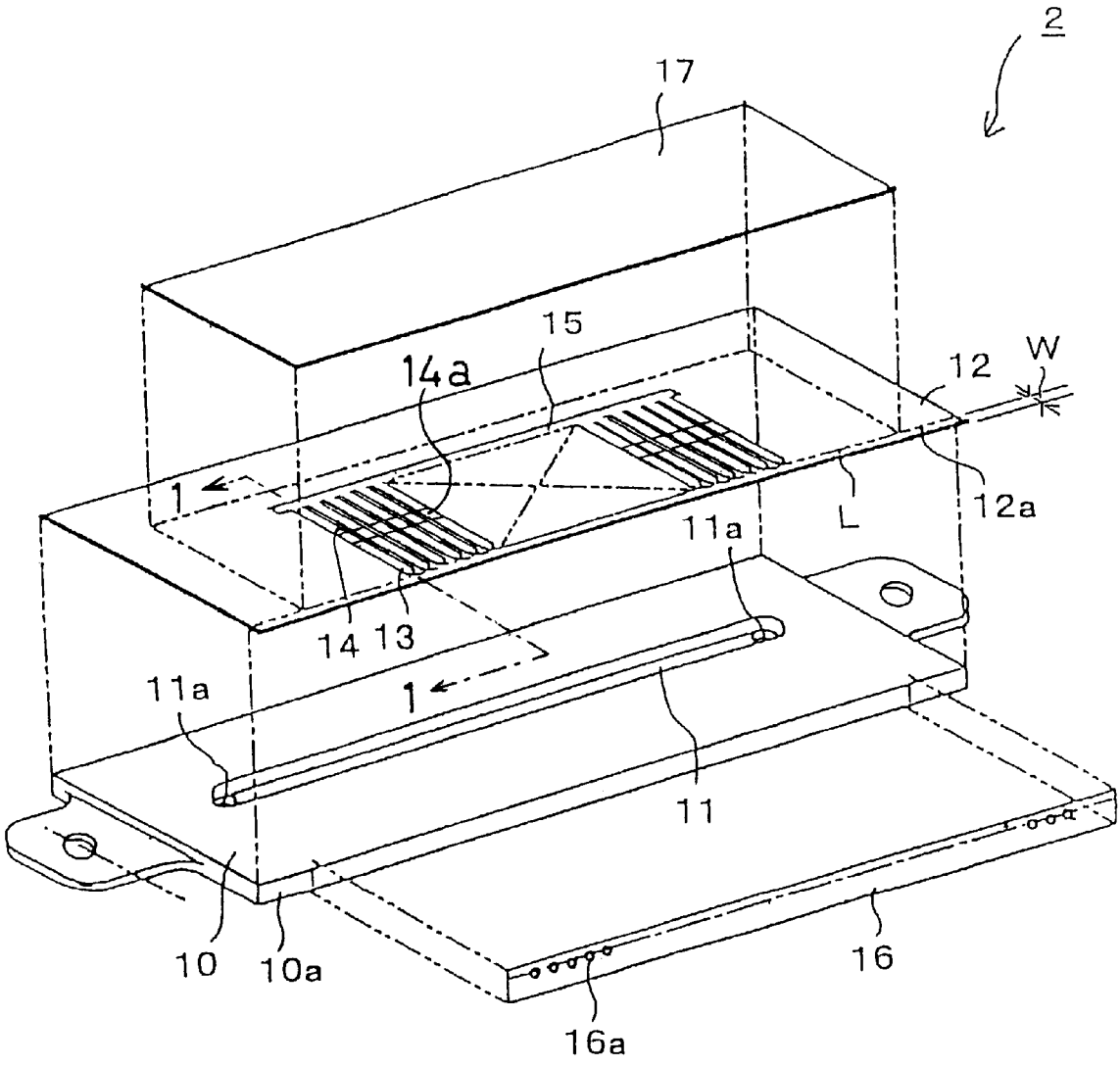
FIG. 8A is an exploded perspective view of an ink-jet printhead according to the fourth embodiment of the invention.
Figure 8B:
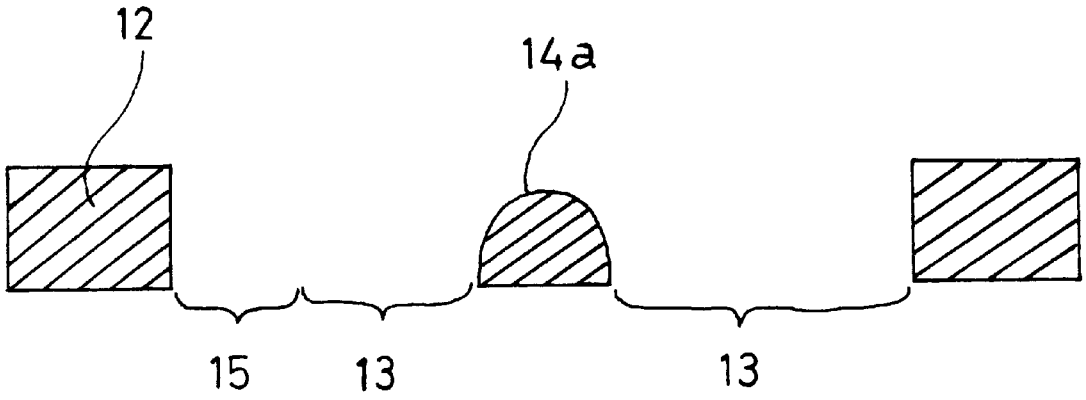
FIG. 8B is a cross-sectional view of the fourth embodiment of the invention taken along plane 1—1 of FIG. 8A.

FIG. 8A is an exploded perspective view of an ink-jet printhead according to the fourth embodiment of the invention, and FIG. 8B is a cross-sectional view of the fourth embodiment of the invention taken along plane 1—1 of FIG. 8A. The fourth embodiment is different from the first embodiment shown in FIG. 1 in that the fourth embodiment includes reinforcement ribs 14*a*, which each have a thickness of approximately 20 to 30 $\mu$m, and a length of 100 to 150 $\mu$m, and serve to reinforce the chamber sheet 12. Since each chamber sheet 12 is very thin and the wall portion between adjacent chambers is very narrow, the chamber sheets 12 of the first, second and third embodiments of the invention tend to become distorted. However, the reinforcement ribs 14*a* of the fourth embodiment of the invention prevent such a distortion. Further, since, as discussed above, the thickness of the reinforcement ribs 14*a* is only 20 to 30 $\mu$m, while the thickness of the chamber sheet 12 is 40 to 50 $\mu$m, the reinforcement ribs 14*a* do not prevent the flow of ink within the ink chambers.

The present invention is not limited to the embodiments described above in which the wire electric discharge machine is utilized in the manufacturing process, and various modifications thereof are possible, such as applying press processes or etching processes to the manufacturing process. Using these processes, the ink channel array constituting the ink chambers 13 is created through the chamber sheet 12, thereby, making it possible to manufacture the cavity plate having the ink chambers 13 with high precision.

What is claimed is:

1. An ink ejecting device, comprising:

a plate-shaped base that defines an ink reservoir;

a chamber sheet having a thickness and being channeled by a plurality of ink chambers so as to form an ink chamber array, the plurality of ink chambers each having side surfaces and an upper surface, the chamber sheet being attached to the base, the side surfaces of each of the plurality of ink chambers being respectively defined by the entire thickness of the chamber sheet; and a piezoelectric element attached to the chamber sheet that causes a pressure change within each of the plurality of ink chambers, wherein the ink reservoir extends in a direction perpendicular to a direction in which the plurality of ink chambers extend and is connected to one end of each of the plurality of ink chambers, and wherein the piezoelectric element is provided with an electrode pattern and covers a surface of the chamber sheet opposite to the base so as to completely cover and define the entire upper surface of the plurality of ink chambers, and the piezoelectric element causes the pressure change within each of the plurality of ink chambers by supplying a voltage to the electrode pattern.

2. The ink ejecting device according to claim 1, wherein the chamber sheet includes a front edge portion, the front edge portion defines opening portions, each opening portion being provided at a tip of each channel of the ink channel array, and further including a nozzle sheet that defines the nozzles, the nozzle sheet being bonded to said front edge portion of the chamber sheet.

3. The ink ejecting device according to claim 1, wherein the chamber sheet includes a front edge portion, said nozzles being provided at the front edge portion of said chamber sheet, and connecting holes are formed through said front edge portion of the chamber sheet so as to connect the ink chambers to the nozzles.

4. The ink ejecting device according to claim 1, wherein said chamber sheet and said base have a similar coefficient of thermal expansion.

5. The ink ejecting device according to claim 1, wherein said base is substantially thicker than said chamber sheet.

6. A method of manufacturing the ink ejecting device of claim 1, wherein ink is supplied from an ink reservoir, and ejected from ink chambers through nozzles, based on a pressure change caused within said ink chambers by a piezoelectric element, the method comprising the steps of:

forming an ink channel array, constituting the ink chambers, at regular intervals in a chamber sheet having a thickness, the ink chambers being defined by the entire thickness of the chamber sheet;

forming the ink reservoir on a plate-shaped base;

bonding said chamber sheet and said base; and connecting an ink chamber of the ink chambers and a nozzle of the nozzles.

7. The method of manufacturing a cavity plate according to claim 6, wherein the step of connecting the ink chamber and the nozzle includes cutting off a front edge portion of the chamber sheet, after the step of bonding the chamber sheet and the base.

8. The method of manufacturing a cavity plate according to claim 6, wherein the step of connecting the ink chamber and the nozzle includes forming the nozzles on the chamber sheet by providing connecting holes through a front edge portion of the chamber sheet so as to connect the nozzles and the ink chambers.

9. The method of manufacturing the ink ejecting device according to claim 6, wherein the step of forming the ink reservoir includes forming the ink reservoir such that a longitudinal direction of the ink reservoir is substantially parallel to a longitudinal direction of the ink channel array.

10. The method of manufacturing the ink ejecting device according to claim 6, wherein the step of bonding the chamber sheet and the base includes bonding the chamber sheet and the base such that the base defines a lower surface of the ink chambers.

11. The method of manufacturing the ink ejecting device according to claim 6, further including the step of disposing a single piezoelectric element so as to define an upper surface of the ink chambers.

12. The ink ejecting device according to claim 1, wherein the chamber sheet defines a slot that is contiguous with a rear end of each ink channel of the ink channel array.

13. The ink ejecting device according to claim 12, wherein the slot of the chamber sheet is contiguous with the ink reservoir of the base when the chamber sheet is attached to the base.

14. The ink ejecting device according to claim 13, wherein the chamber sheet defines openings, each opening being contiguous with a front end of each ink channel of the ink channel array.

15. The ink ejecting device according to claim 14, wherein the front end of each ink channel has a smaller cross-sectional area than the rear end.

16. The ink ejecting device according to claim 15, wherein the front end of each ink channel is symmetrically tapered.

17. The ink ejecting device according to claim 16, wherein the base is formed of at least one of aluminum and magnesium.

18. The ink ejecting device according to claim 17, wherein the chamber sheet is formed of at least one of stainless steel and nickel.

19. The ink ejecting device according to claim 18, wherein the chamber sheet is attached to the base via a resinous adhesive having a glass transition point at 130 to 150° C.

20. The ink ejecting device according to claim 1, further including a nozzle sheet that defines the nozzles, the nozzle sheet being attached to a lower surface of the plate-shaped base, and wherein the plate-shaped base defines channels that connect the ink chambers to the nozzles.

21. The ink ejecting device according to claim 1, further including reinforcement ribs that structurally reinforce the chamber sheet.

22. The ink ejecting device according to claim 21, wherein the reinforcement ribs are formed in approximately a center portion of the ink chambers in a lengthwise direction.

23. The ink ejecting device according to claim 21, further including wall portions disposed adjacent ink chambers, and wherein the reinforcement ribs are thinner than the wall portions.

24. The ink ejecting device according to claim 23, wherein a thickness of the reinforcement ribs is approximately one half a thickness of the wall portions.

25. The ink ejecting device according to claim 1, wherein a longitudinal direction of the ink reservoir is substantially parallel to a longitudinal direction of the ink channel array.

26. The ink ejecting device according to claim 1, wherein the plate-shaped base defines a lower surface of the ink chambers.

27. The ink ejecting device according to claim 1, wherein the piezoelectric element constitutes a single piezoelectric element that defines an upper surface of the ink chambers.

28. The ink ejecting device according to claim 1, wherein the base covers a surface of the chamber sheet opposite to the piezoelectric element so as to cover the plurality of ink chambers except for the one end of each of the plurality of ink chambers.

* * * * *